US009365389B2

(12) United States Patent
Armour et al.

(10) Patent No.: US 9,365,389 B2
(45) Date of Patent: Jun. 14, 2016

(54) BELT DELIVERY AND REMOVAL SYSTEM

(71) Applicant: Joy MM Delaware, Inc., Wilmington, DE (US)

(72) Inventors: Daniel J. Armour, Winfield, AL (US); Larry Atkinson, Winfield, AL (US); Donald Allen, London, KY (US); Delbert Preuninger, Winfield, AL (US)

(73) Assignee: Joy MM Delaware, Inc., Wilmington, DE (US)

( * ) Notice: Subject to any disclaimer, the term of this patent is extended or adjusted under 35 U.S.C. 154(b) by 83 days.

(21) Appl. No.: 14/229,197

(22) Filed: Mar. 28, 2014

(65) Prior Publication Data

US 2014/0291434 A1 Oct. 2, 2014

Related U.S. Application Data

(60) Provisional application No. 61/806,163, filed on Mar. 28, 2013.

(51) Int. Cl.
*B65G 15/60* (2006.01)
*B65H 75/44* (2006.01)
*B65H 75/36* (2006.01)

(52) U.S. Cl.
CPC ..... *B65H 75/4486* (2013.01); *B65H 75/36* (2013.01); *B65H 2701/37* (2013.01)

(58) Field of Classification Search
CPC ... B65H 75/36; B65H 75/425; B65H 75/4486
USPC ..... 198/812, 844.2
See application file for complete search history.

(56) References Cited

U.S. PATENT DOCUMENTS

| | | | | |
|---|---|---|---|---|
| 2,166,447 | A * | 7/1939 | Ruppenthal | 198/812 |
| 2,499,119 | A | 2/1950 | Smith et al. | |
| 2,554,037 | A * | 5/1951 | Lee | 384/537 |
| 2,576,217 | A * | 11/1951 | Eggleston | 198/313 |
| 2,652,206 | A | 9/1953 | Baechli | |
| 2,846,051 | A | 8/1958 | Craggs et al. | |
| 4,063,691 | A | 12/1977 | Bacvarov | |
| 4,195,726 | A | 4/1980 | Denny et al. | |
| 4,208,022 | A | 6/1980 | Wimberly | |
| 4,227,660 | A | 10/1980 | Denny et al. | |

(Continued)

OTHER PUBLICATIONS

International Search Report for PCT/US2014/032237 completed Aug. 2, 2014 (8 pages).

(Continued)

*Primary Examiner* — Sang Kim
(74) *Attorney, Agent, or Firm* — Michael Best & Friedrich LLP

(57) ABSTRACT

A delivery and removal system used to transport, install, and remove a belt for use with mining equipment. The system includes a first frame member and a second frame member. A deck extending between the first frame member and the second frame member, and a winder is supported by the deck and rotatable relative to the first frame member and the second frame member about the deck. The system includes a drive system for driving movement of the winder. A free end of the belt is coupled to the winder. When the drive system is driven in a first direction, the winder rotates in a first direction such that the belt winds about the deck and when the drive system is driven in a second direction, the winder rotates in a second direction such that the belt unwinds from the deck.

15 Claims, 9 Drawing Sheets

(56) References Cited

U.S. PATENT DOCUMENTS 5,201,406 A 4/1993 Kellis
5,735,482 A 4/1998 Kuzik

OTHER PUBLICATIONS

Written Opinion for PCT/US2014/032237 completed Aug. 2, 2014 (4 pages).

* cited by examiner

BELT DELIVERY AND REMOVAL SYSTEM

CROSS-REFRENCE TO RELATED APPLICATIONS

This application claims priority from U.S. Provisional Application No. 61/806,163, filed on Mar. 28, 2013, the entire contents of which are incorporated herein by reference.

BACKGROUND

The present invention relates to mining equipment and specifically, a delivery and removal system for transporting, installing, and removing belts used with mining equipment.

Belts are used in conjunction with mining equipment in order to remove material or debris from a mining site. As the mine site is established, the mining equipment must be adjusted or moved. In order for the mining equipment to be adjusted, the belts are often installed, removed, and reinstalled, which is a difficult, strenuous, and time-consuming process.

SUMMARY

In one embodiment, the invention provides a delivery and removal system used to transport, install, and remove a belt for use with mining equipment. The system includes a first frame member and a second frame member. A deck extends between the first frame member and the second frame member, and a winder is supported by the deck and rotatable relative to the first frame member and the second frame member about the deck. The system includes a drive system for driving movement of the winder. A free end of the belt is coupled to the winder. When the drive system is driven in a first direction, the winder rotates in a first direction such that the belt winds about the deck and when the drive system is driven in a second direction, the winder rotates in a second direction such that the belt unwinds from the deck.

In one embodiment, the invention provides a delivery and removal system used to transport, install, and remove a belt for use with mining equipment. The system includes a first frame member and a second frame member. A deck extends between the first frame member and the second frame member. A connecting member forms a continuous loop about the deck, and a free end of the belt is removably coupled to the connecting member. A drive system is configured to drive movement of the connecting member about the deck. When the drive system is driven in a first direction, the connecting member moves in a first direction about the deck such that the belt winds about the deck, and when the drive system is driven in a second direction, the connecting member moves in a second direction about the deck such that the belt unwinds from the deck.

In another embodiment the invention provides a method for removably coupling a belt for use with mining equipment to a belt delivery and removal system. The system includes a first frame member coupled to a second frame member by a deck and a winder being supported by the deck and rotatable relative to the first frame member and the second frame member. The method includes creating a free end of the belt, coupling the free end of the belt to the winder, and rotating the winder about the deck, by a drive system, in a first direction such that the belt winds about the deck forming a spool.

Other aspects of the invention will become apparent by consideration of the detailed description and accompanying drawings.

Before any embodiments of the invention are explained in detail, it is to be understood that the invention is not limited in its application to the details of embodiment and the arrangement of components set forth in the following description or illustrated in the following drawings. The invention is capable of other embodiments and of being practiced or of being carried out in various ways.

Brief Description of the Drawings

In one embodiment, the invention provides a delivery and removal system used to transport, install, and remove a belt for use with mining equipment. The system includes a rotatable winder that winds and unwinds the belt relative to first and second frame members. The winder winds the belt in a first direction to store and transport the belt, and the winder unwinds the belt in a second, opposite direction to install and remove the system from a mining site.

Figure 1:
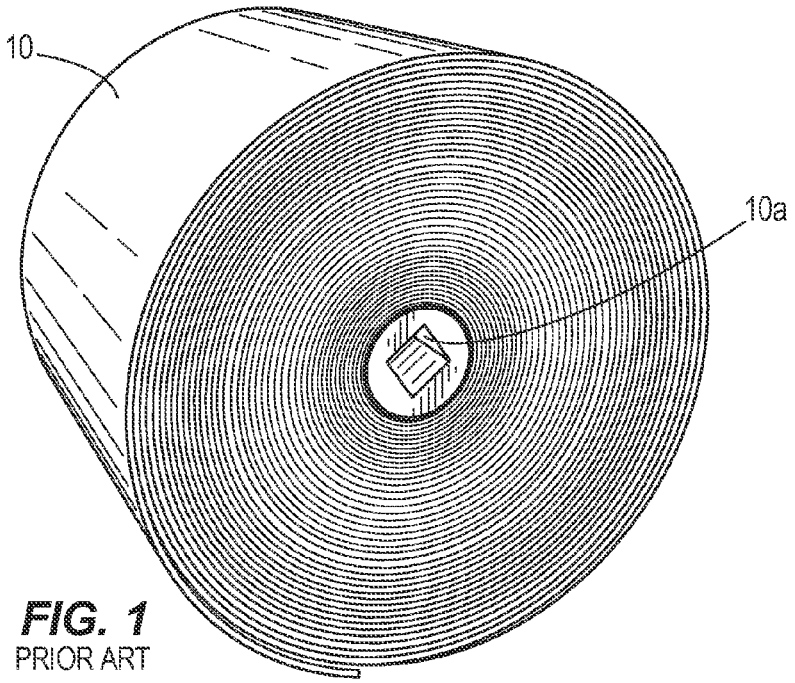
FIG. 1 PRIOR ART
FIG. 1 is a perspective view of a conventional spool about which a belt is wound.
Figure 2:
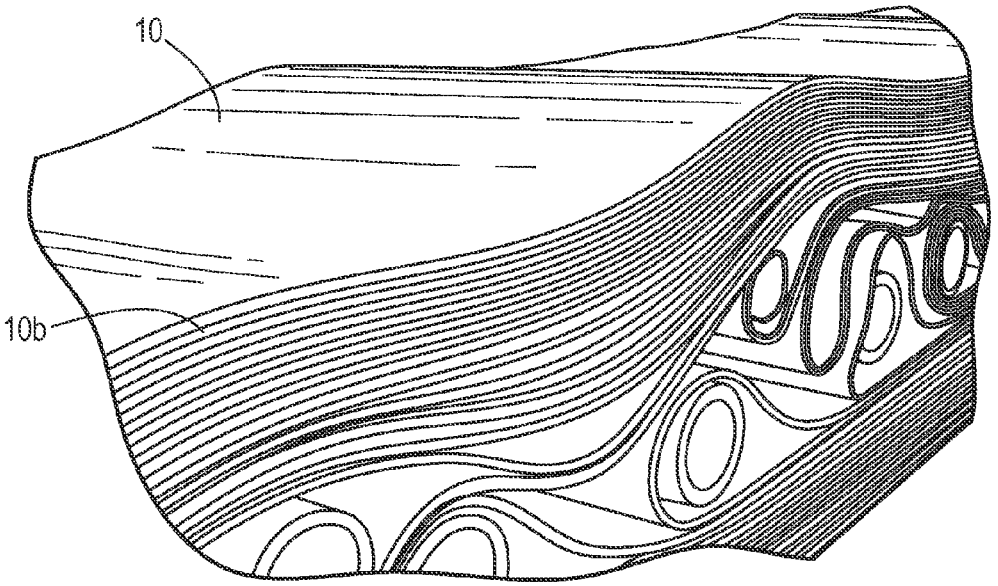
FIG. 2 PRIOR ART
FIG. 2 is a perspective view of a belt in a ship-lapped state.
Figure 3:
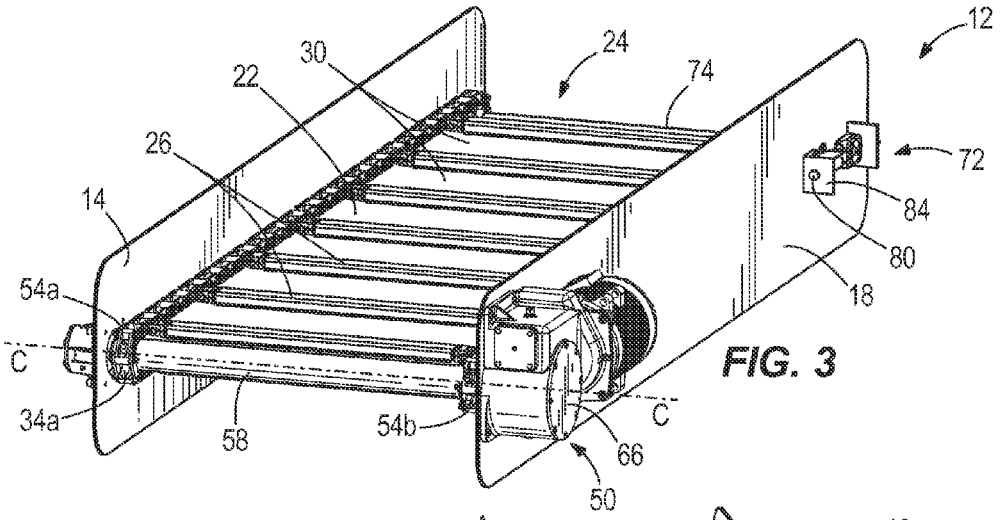
FIG. 3 is a front perspective view of a belt delivery and removal system according to one embodiment of the invention.

Belts 10 are used in conjunction with various types of mining equipment (i.e., conveyors and the like) in order to transport cut material from a working face of a mine. The belts 10 must be transported, installed and removed multiple times in the advancement and retreat process used in underground mines. The current method of delivery is to wind the belts 10 onto round spools 10*a* (FIG. 1). When wound, the spools 10*a* have a diameter ranging from about 7 feet to about 10 feet. However, mine entries are typically only about 5 feet to about 8 feet tall and can only accommodate objects having a height of between about 4 feet to about 6 feet. Therefore, in order to transport, install, and remove the belts 10, operators rely on a "ship lap" process that requires unwinding the spool onto a transport vehicle such that the belt takes on a random overlapping orientation 10*b* (FIG. 2). The ship lap process is difficult, strenuous, and time-consuming.

FIGS. 3-6 illustrate a belt delivery and removal system 12 according to one embodiment of the invention, which overcomes the disadvantages described above with respect to conventional systems. With respect to FIGS. 3 and 4, the system 12 includes a first frame member 14 opposite a second frame member 18. A rotatable winder or conveyor 22 defines a middle portion 24, which extends between the first and second frame members 14, 18. The winder 22 is rotatable relative to both the first frame member 14 and the second frame member 18.

In the embodiments illustrated in FIGS. 3-6, the winder 22 includes flight bars 26 that are spaced apart from one another. The flight bars 26 are configured in a continuous loop about a deck 30, which connects the frame members 14, 18. The deck defines a longitudinal axis A of the system 12. At least one chain 34 is attached to the flight bars 26 and forms a continuous loop about the middle portion 24. In the illustrated embodiment, there are two chains or connecting members 34 attached to the flight bars 26; a first chain 34*a* is disposed adjacent the first frame member 14 and a second chain 34*b* is disposed adjacent the second frame member 18. Additional or alternate embodiments may include fewer or more chains 34 that may be oriented in different orientations relative to the first and second frame members 14, 18 (e.g., one chain that is centrally located between the first and second frame members). Additionally, connecting members in the form of a belt or strap may be used instead of the chains illustrated herein to connect the flights bars 26 to one another about the middle portion 24. The flight bars 26 are spaced equidistantly apart along the middle portion 24. In some embodiments, the spacing between the flight bars 26 can be altered. Various numbers of and configurations for the flight bars 26 may be used. In some embodiments, rather than utilizing flight bars 26, different structures can be used. In the illustrated embodiment, the winder 22 is similar to a conveyor and includes many similar features to a conveyor (e.g., the chains 34*a*, 34*b* are similar to conveyor chains); additional or alternative embodiments may include a winder 22 having alternative embodiments, which will be discussed below.

The system further includes a drive system 50 having a drive shaft 58 coupled to and extending between the first frame member 14 and the second frame member 18. The drive shaft 58 defines an axis B, which is perpendicular to the longitudinal axis A of the system 12 in the illustrated embodiment. The drive system 50 includes two drive sprockets 54. A first drive sprocket 54*a* is disposed at a first end of the drive shaft 58 and a second drive sprocket 54*b* is disposed at a second, opposite end of the drive shaft 58. The drive sprockets 54*a*, 54*b* drive movement of the chains 34*a*, 34*b* around the loop. Specifically, the drive sprockets 54*a*, 54*b* are provided with teeth 62 constructed and arranged to drivingly engage the chain. It is to be appreciated that other embodiments may utilize any suitable number of teeth depending, for example, on the pitch of the particular type of chain 34 being used. Furthermore, while the illustrated embodiment includes two drive sprockets 54*a*, 54*b*, it is possible for other embodiments to use a single drive sprocket, or more than two drive sprockets.

Figure 4:
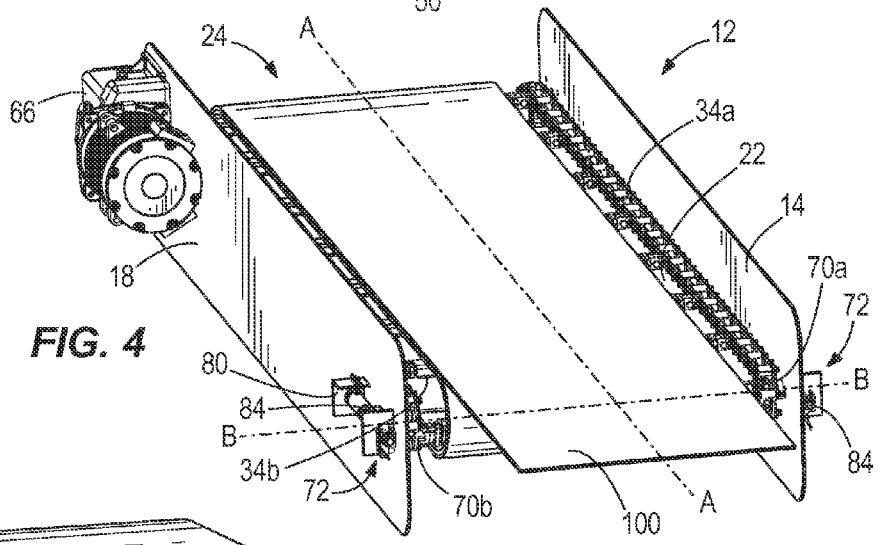
FIG. 4 is a rear perspective view of the belt delivery and removal system of FIG. 3.
Figure 5:
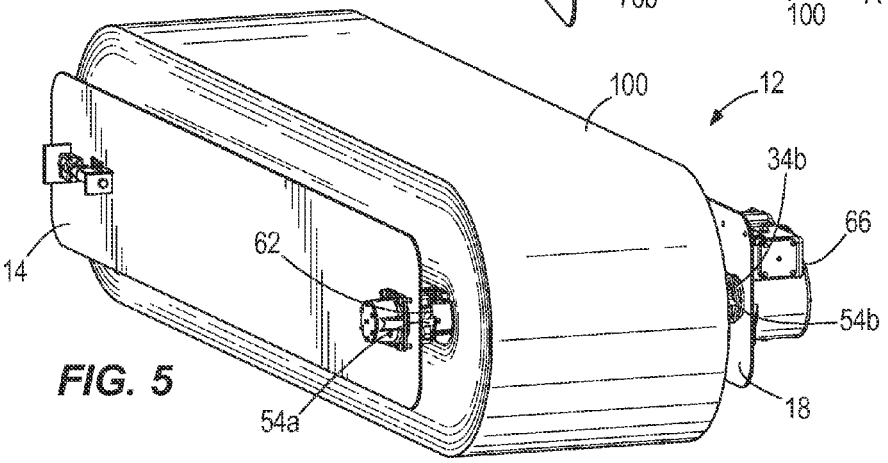
FIG. 5 is a front perspective view of the belt delivery and removal system of FIG. 3 including a belt.

The drive sprockets 54*a*, 54*b* are attached to, or formed integrally with, the drive shaft 58. In the illustrated embodiment, the drive shaft 58 extends generally parallel to the flight bars 26 and generally perpendicular to the direction of motion of the chains. The drive shaft 58 is configured to receive a power take off shaft (not shown) from a prime mover 66 (e.g., a motor). While only one prime mover 66 is illustrated, it is contemplated that multiple movers may be included in the system 12. Additionally, the prime mover may be removable from the frame members such that one motor and drive assembly is usable with different systems. If removable, the prime mover is attachable to the frame member and drive shaft by a quick coupling method. Because the prime mover is removable, the system also acts as storage spools for storing the belt 100. When the drive shaft 58 is turned via (i.e., actuated by) the prime mover 66, the drive sprockets 54*a*, 54*b* are turned with the drive shaft 58, providing a mechanism by which the winder 22 is moved. Thus, as illustrated in FIG. 4 in particular, the prime mover 66 operatively communicates with the drive sprocket 54*a*, 54*b* to advance the winder 22. In particular, the winder 22 is rotatable about the deck 30 about an axis C, which is perpendicular to the longitudinal axis A in the illustrated embodiment. In other words, the continuous loop of the flight bars and the continuous loop of the first chain are rotatable about the axis C as well.

The drive system 50 further includes retention rollers (not shown) positioned between the drive sprockets 54*a*, 54*b* and a portion of the chains 34*a*, 34*b*, respectively. In one embodiment, the chains 34*a*, 34*b* move between the retention rollers and the drive sprockets 54*a*, 54*b*, along a top of the drive sprockets 54*a*, 54*b*. The retention rollers maintain tension in the chains 34*a*, 34*b* and inhibit slack in the chains 34*a*, 34*b* by directing the chains 34*a*, 34*b* over the drive sprockets 54*a*, 54*b*. The retention rollers rotate about axes that are parallel to an axis of rotation of the drive shaft 58.

In the illustrated embodiments, the drive shaft 58 is located at a forward-most point of the winder 22 within the system 12, and provides a turn-around point for the first and second chains 34*a*, 34*b*. The winder 22 further includes first and second rear sprockets 70*a*, 70*b*. The rear sprockets 70*a*, 70*b* are coupled to first and second opposite ends of a roller or shaft 74, which defines the rearward-most point of the winder 22 of the system 12, and provide another turn-around point for the chains 34*a*, 34*b*. Each of the chains 34*a*, 34*b* is in engagement with one of the first or second drive sprockets 54*a*, 54*b* and one of the rear sprockets 70*a*, 70*b*. The drive sprockets 54*a*, 54*b* and rear sprockets 70*a*, 70*b* change the direction of the chains 34*a*, 34*b* thereby moving the chains 34*a*, 34*b*, in a continuous loop.

A tensioning mechanism 72 is incorporated in the winder 22 as well. In the illustrated embodiment, the tensioning mechanism 72 includes hydraulically operated arms 80 on each side of the system 12 that dynamically adjust the tension on the belt 100. The arm 80 is coupled between a projection 84 of the first frame member 14 and the roller 74. The arm 80 is linearly movable to adjust the tension of the roller 74 on the belt 100 as it is wound about the deck 30. In the illustrated embodiment, the arm 80 is movable in parallel with the longitudinal axis A of the system and perpendicular to an axis B of the roller 74. In other embodiments, the arm 80 may be oriented at an angle relative to the axes A, B of the roller 74. Additionally, rather than being hydraulically operated, the arm 80 could be movable by a spring-dampened arm, for example, or the arm 80 may have other suitable configurations.

The tensioning mechanism 72 ensures that the belt 100 is tightly wound in ovular manner by preventing slack in the chains 34*a*, 34*b*. In other words, the tensioning mechanism 72 eliminates slack that may be introduced between revolutions of the winder 22 that causes the belt 100 to sag. Further, winding the belt 100 tightly helps to properly align the belt 100 between the two frame members 14, 18. In additional or alternative embodiments, a tensioning mechanism may provide resistance to the belt 100, rather than the chains 34*a*, 34*b*, to ensure that the belt 100 is wound in a consistent manner. Additionally, there may be greater or fewer rollers near the rearward-most point of the winder 22 of the system 12 that also help to prevent the belt from sagging while in use.

Figure 6:
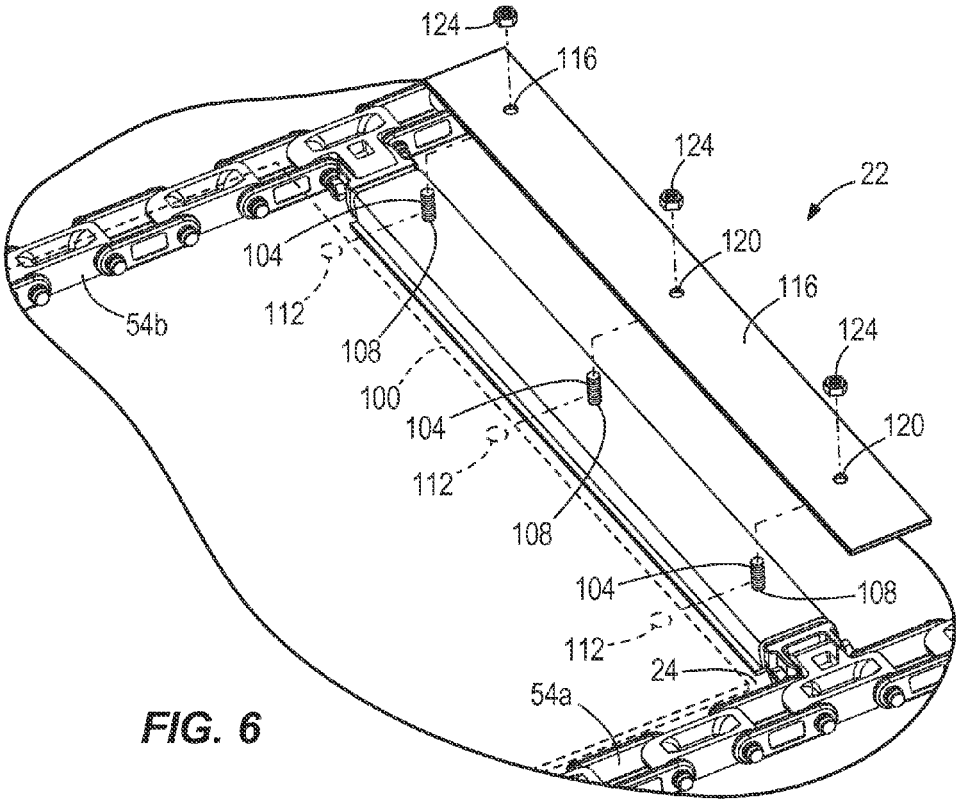
FIG. 6 is detailed perspective view of the belt delivery and removal system of FIG. 3.

Prior to winding the belt 100, tension on the belt 100 is removed via a take-up such that the belt 100 is split at a seam or splice. The winder 22 of the system 12 is then attached to a first, free end of the belt 100 (FIG. 6). In particular, the free end of the belt 100 is then attached to one of the flight bars 26. As illustrated in FIG. 6, one or more bolts or fasteners 104 extend through holes 108 in the flight bars 26 that are aligned with holes 112 in the free end of the belt 100. A plate 116, which is formed from steel or another suitable metal, is positioned over the free end of the belt 100 such that the bolts 104 extend through holes 120 in the plate 116 that are aligned with the holes 108, 112 in the flight bars 26 and belt 100, respectively. A nut or other connector 124 is coupled to each of the bolts 104 after the bolts 104 are positioned through the holes 108, 112, 120 in the flight bar 26, belt 100, and the plate 116 such that the free end of the belt 100 is coupled to the winder 22. The plate 116 is an auxiliary structure; other embodiments may not include the plate 116. In the illustrated embodiment there are three holes 108, 112, 120 in each of the flight bar 26, belt 100, and plate 116, each receiving one of the bolts 104. In other embodiments, there may be greater or fewer holes and bolts used to couple the belt 100 to the flight bar 26.

Figure 6A:
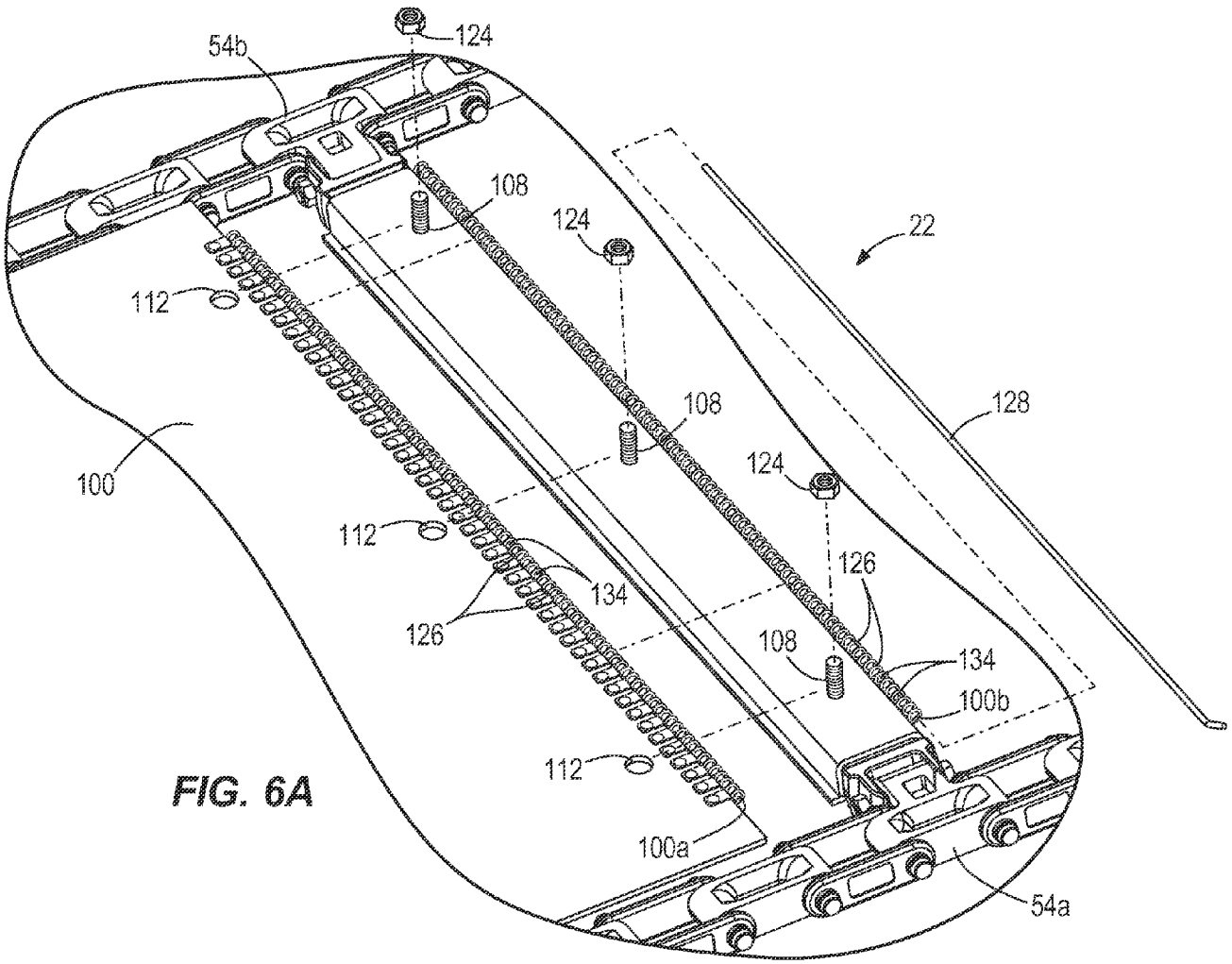
FIG. 6A is a detailed perspective view of a belt delivery and removal system according to another embodiment of the invention.
Figure 7A:
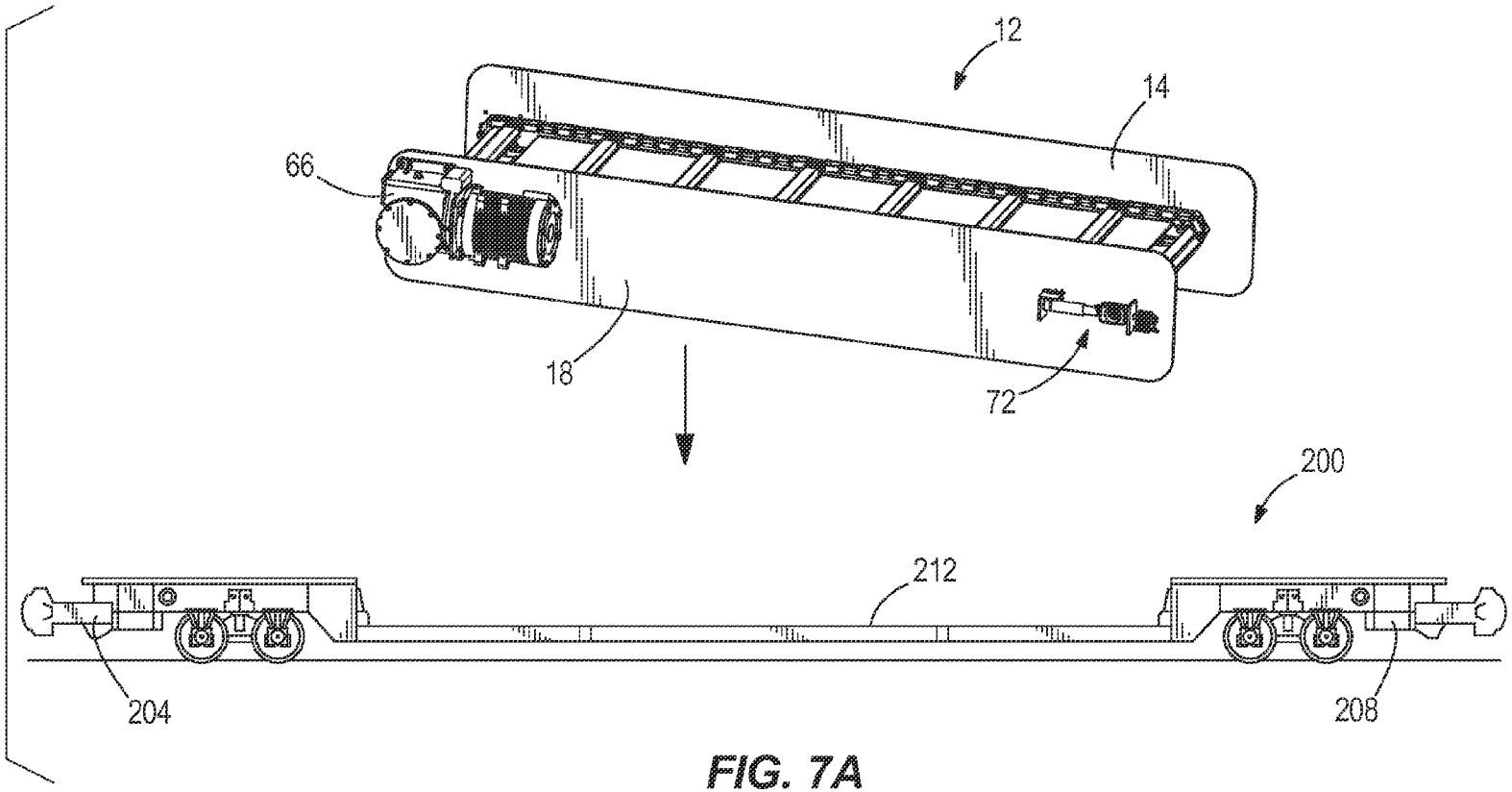
FIGS. 7A-7C are exploded views of an exemplary vehicle used to transport the belt delivery and removal system of FIGS. 3-5.
Figure 7B:
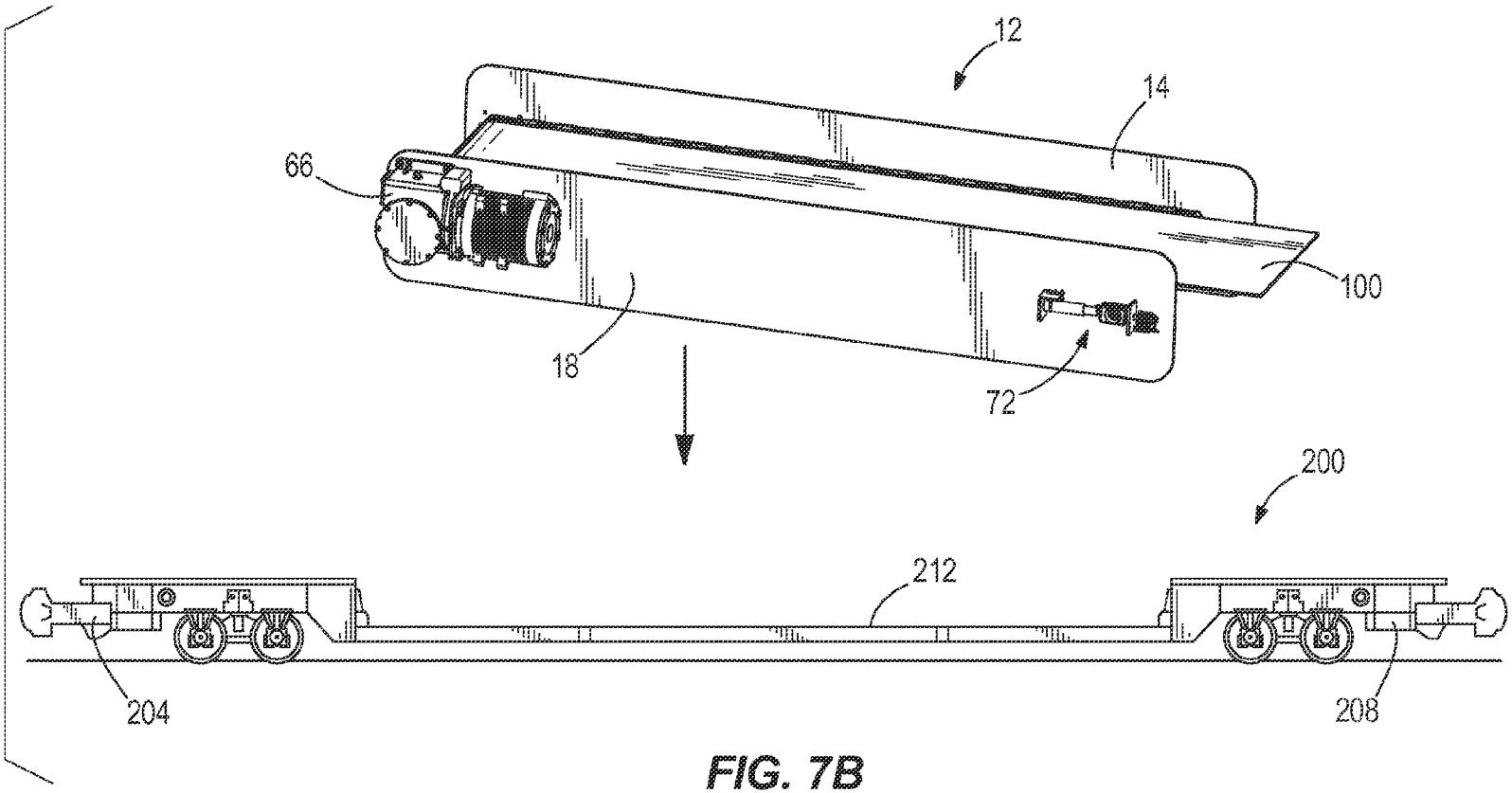
Figure 7C:
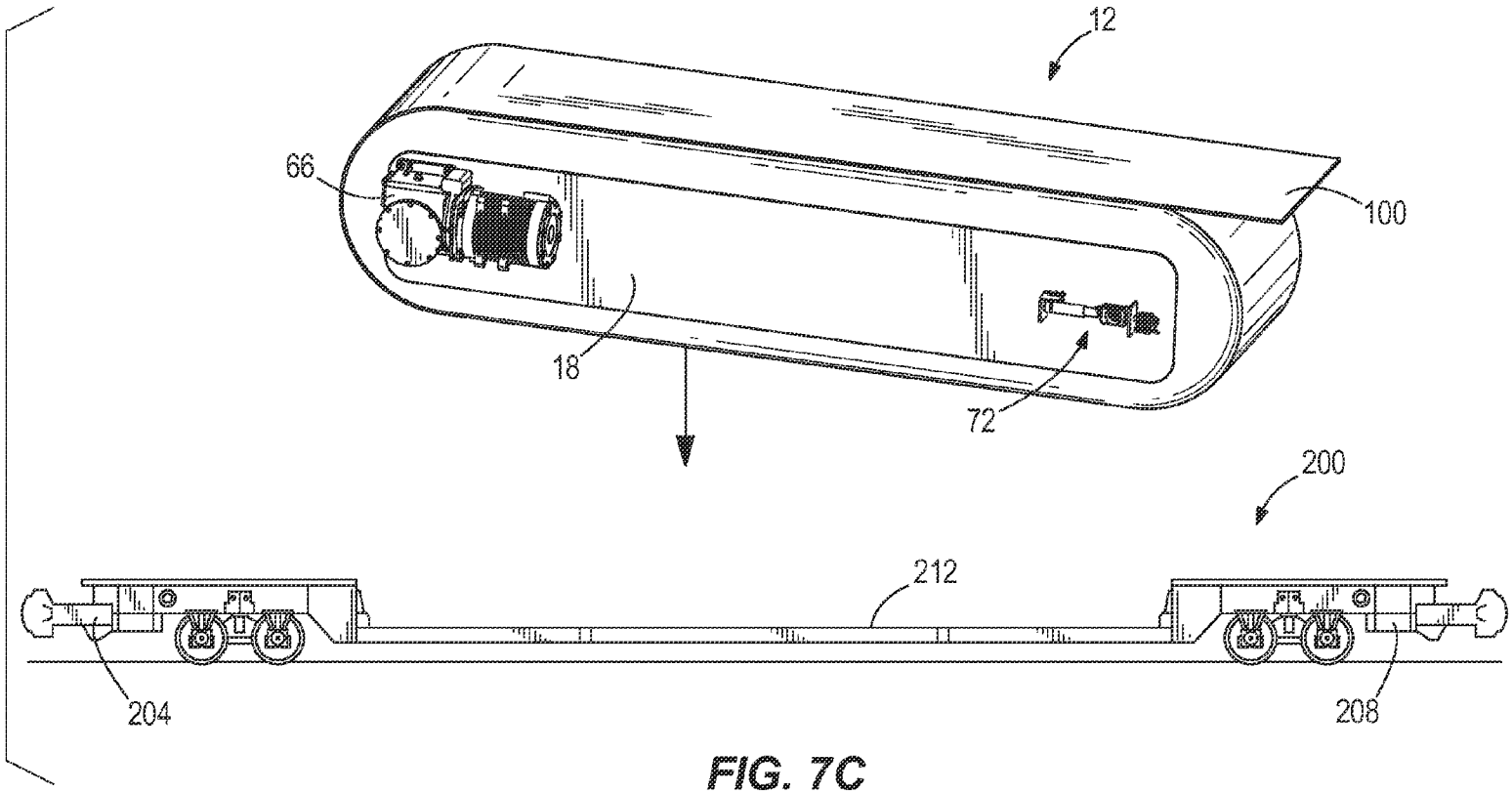

In addition to or alternatively, the winder 22 may include a connection or splice member 100*b* that is configured to connect to a connection or splice member 100*a* on the belt 100. With reference to FIG. 6A, the connection member 100*b* is coupled to the flight bar 26 to matingly receive the connection member 100*a* of the conveyor belt 100. FIG. 6A illustrates that each of the connection members 100*a*, 100*b* includes fingers 126 that are spaced apart from one another and include an aperture 134. Fingers 126 of the connection member 100*a* are received between the fingers 126 of the connection member 100*b* such that the apertures 134 of each of the fingers 126 are aligned, and the belt 100 and the flight bar 26 may be spliced together. Once the connection members 100*a*, 100*b* are positioned relative to one another, the members 100*a*, 100*b* are secured to one another by a pin 128 that extends through the aligned apertures 134.

In this way, the conveyor belt 100 is attached to the winder 22 along a seam that formerly attached the belt 100 to the remainder of the conveyor belt (not shown). The mechanical connection member 100*b* coupled to the flight bar 26 is specific to the type of connection member 100*a* of the conveyor belt, and therefore, may have other configurations than that illustrated herein. The splice connection between the conveyor belt 100 and the winder 22 makes coupling the conveyor belt 100 to the winder 22 easier and quicker. As illustrated in FIG. 6A, the conveyor belt 100 is also coupled to the flight bar 26 by the bolts 104 extending through the holes 112 in the conveyor belt in addition to the mechanical splice therebetween. While not illustrated, it should be understood that the plate 116 may be used as well with the mechanical splice. In other embodiments, the holes 112 and the bolts 104 may be omitted.

As the chains 34*a*, 34*b*, and therefore the flight bars 26, move in a first direction about the continuous loop, the winder 22 winds the belt 100 automatically about the middle portion 24. As the belt 100 continues to wind about the middle portion 24, the belt 100 is wound to a substantially transport or storage position (FIG. 5), at which point the belt 100 is split at another splice. Once the belt 100 is wound to the transport position, the belt 100 may be removed from a mining site. As the chains 34*a*, 34*b* move in a second direction, about the continuous loop, which is opposite the first direction, the winder 22 unwinds the belt 100 automatically from the middle portion 24. As the belt 100 continues to unwind from the system 12, the belt 100 may be delivered and installed to a mining site. Additionally, the system 12 can be used to convert the belt 10 from a round spools (FIG. 1) or lapped belts 10*b* (FIG. 2) into an ovular spools (FIGS. 3-10). In particular, the belt 10, 10*b* is wound onto the system 12 as discussed above and then transported as an ovular spool to an underground mine site to be installed on a conveyor system.

Because the belt 100 is wound and unwound automatically by the winder 22, the belt 100 is easily installed and removed from a mining site. Additionally, the middle portion 24 of the system 12 is elongated; therefore, the belt 100 may be wound in a substantially ovular orientation, which decreases the revolutions necessary to wind the belt 100, thereby decreasing the height of the wound belt 100. The decreased height of the system 12 when the belt 100 is wound allows the belt 100 to be easily and efficiently transported into and out of a mine for installation and removal. The system 12 is customizable to accommodate heights and widths of each mining site as well as the conveyor belts 100 that are used at various mining sites. In other words, the frame height and width and the height and width of a belt 100 that is spooled by the system 12 can be adjusted according to the needs of the customer.

The system 12 is transportable on a transport vehicle 200 (FIGS. 7A-7C) to facilitate the movement of the system 12 into and out of the mine to deliver or remove the belt 100 therefrom. For example, the transport vehicle 200 of FIGS. 7A-7C includes a first wheeled section 204 connected to a second wheeled section 208 by a recessed platform 212 therebetween. The system 12 is placed on the platform 212 such that the height of the system 12, including the belt 100 and the transport vehicle 200, is kept to a minimum. As such, the belt 100 may be transported into and out a mine in order to easily install and remove belts as needed. In additional or alternative embodiments, the system may include wheels that facilitate the movement of the system 12 into and out of the mine. For example, the system 12 may be independently driven or incorporated as a trailer-like structure in order to move the system 12.

Figure 8:
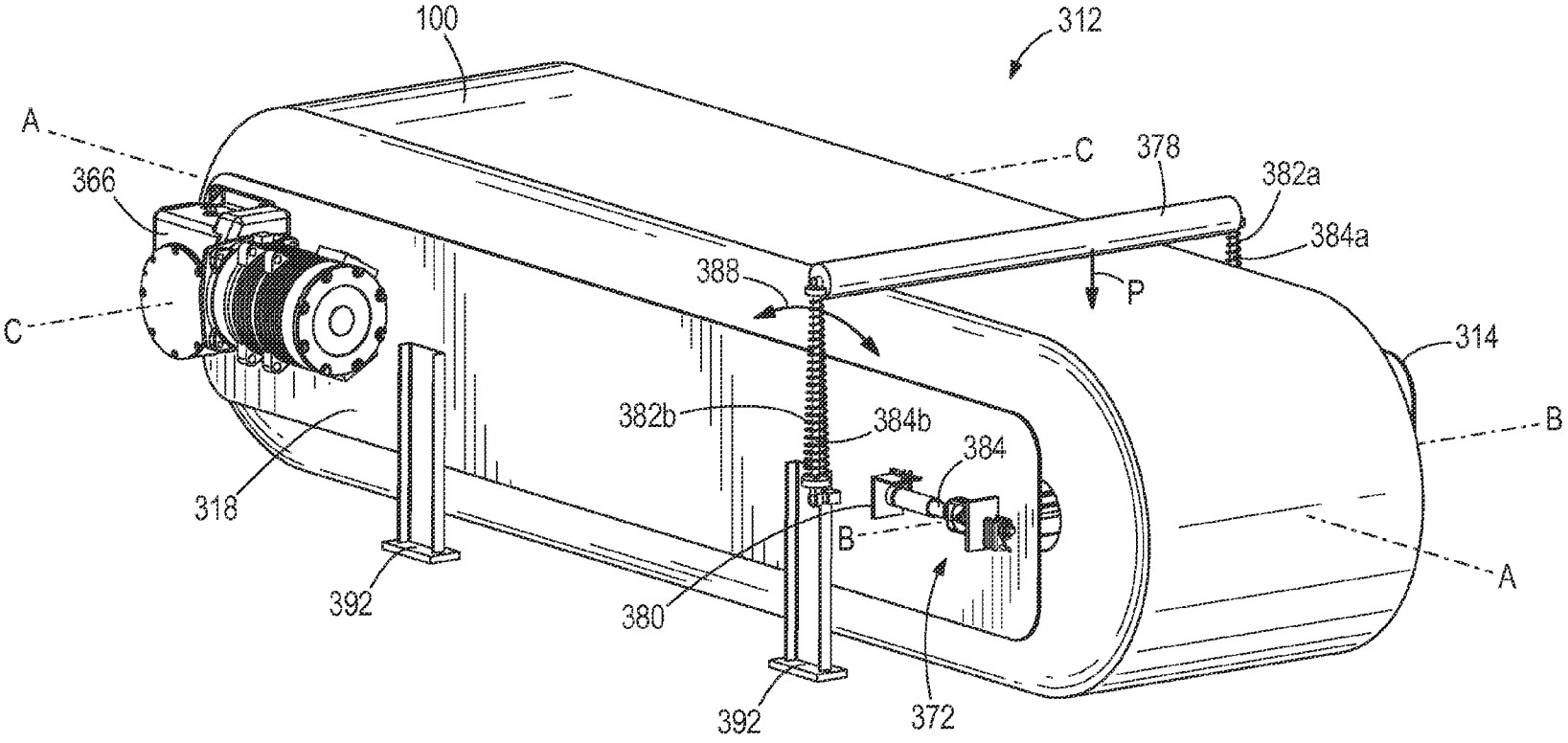
FIG. 8 is a rear perspective view of a belt delivery and removal system according to another embodiment of the invention.

FIG. 8 illustrates a belt delivery and removal system 312 according to another embodiment of the invention. The system 312 of FIG. 8 is similar to the system 12 of FIGS. 3-7C; therefore, like structure will be identified by like reference numerals plus "300" and only differences will discussed hereafter.

The belt delivery and removal system 312 includes an elevated roller 378. The elevated roller 378 is attached to first and second legs 382*a*, 382*b* at opposite ends thereof. The legs are coupled to first and second frame members 314, 318, respectively and each include a biasing mechanism or spring 384*a*, 384*b*. The springs 384*a*, 384*b* allow the legs 382*a*, 382*b*, and therefore the elevated roller 378, to oscillate about a pivot point. The direction of movement of the legs 382*a*, 382*b* is along arrow 388. The elevated roller 378 contacts and applies a pressure (indicated by the arrow P) to the belt 100 as each new revolution is executed such that the belt 100 is encouraged to maintain a substantially ovular shape with each revolution as it continuously wound. The elevated roller 378 also helps to maintain a smooth delivery of the belt 100 as the belt 100 is unwound. While the elevated roller 378 is disposed above the system 312, it should be understood that the roller could be disposed below the system 312 in additional or alternative embodiments. Additionally, greater or fewer rollers 378 may be used than are illustrated herein.

The belt delivery and removal system 312 of FIG. 8 also includes stilts or legs 392. The legs allow the frame members 314, 318 to be elevated such that portions of the belt 100, when wound, extend below the frame members 314, 318 as well as above the frame members 314, 318. While legs 392 are only illustrated as being coupled to the frame member 318, it should be understood that there are substantially identical legs 392 coupled to the frame member 314, although not illustrated. Additionally, in alternative embodiment, the removal system may be supported in other ways.

Figure 10:
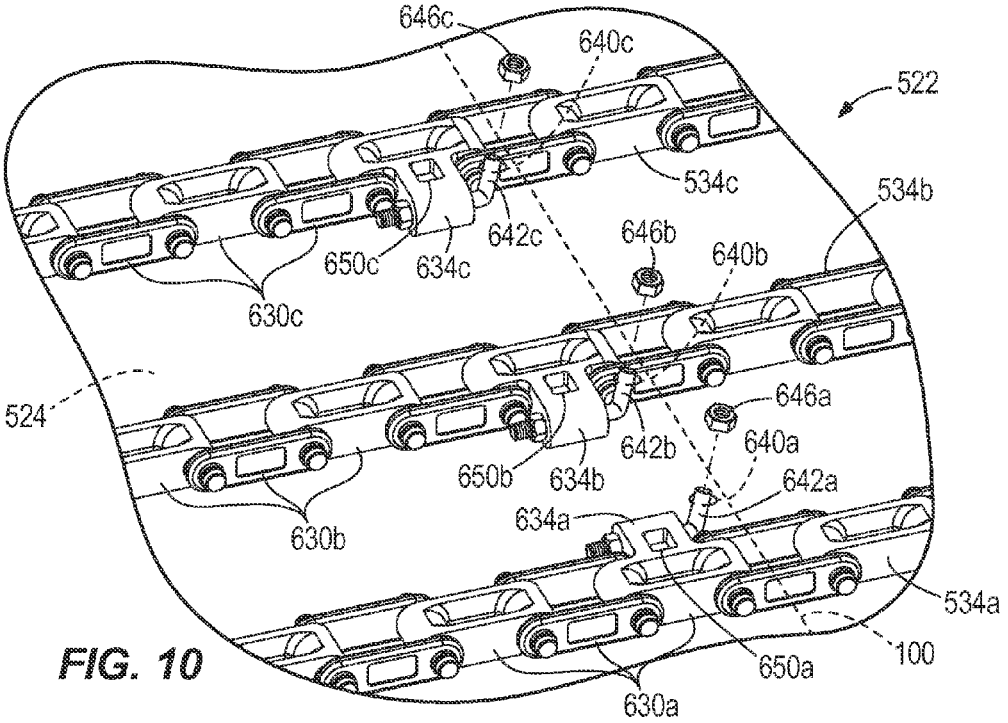
FIG. 10 is detailed perspective view of the belt delivery and removal system of FIG. 9.
Figure 9:
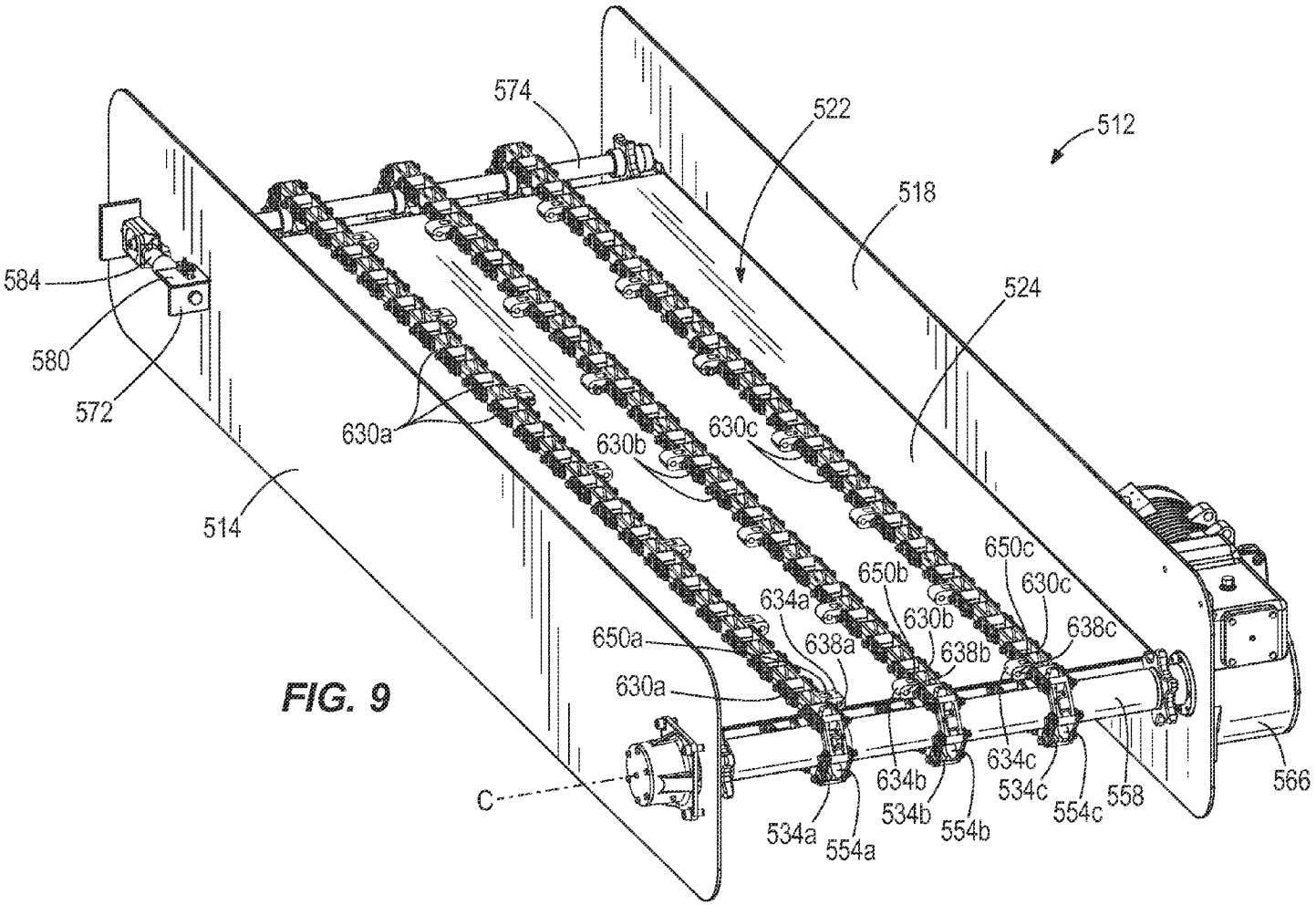
FIG. 9 is a front perspective view of a belt delivery and removal system according to another embodiment of the invention.

FIGS. 9 and 10 illustrate a belt delivery and removal system 512 according to another embodiment of the invention. The system 512 of FIGS. 9 and 10 is similar to the system 12 of FIGS. 3-7C; therefore, like structure will be identified by like reference numerals plus "500" and only differences will discussed hereafter.

In the embodiment of FIGS. 9 and 10, the winder 522 does not include flight bars. Instead, first, second, and third chains or connecting members 534*a*, 534*b*, 534*c* each form continuous loops about the middle portion or deck 524. Similar to the embodiment of FIG. 3-7C, the chains 534*a*, 534*b*, 534*c* of FIGS. 9 and 10 are coupled to the drive shaft 558 by sprockets 554*a*, 554*b*, 554*c* attached thereto. Therefore, rotation of the drive shaft 558 by the prime mover 566 rotates the chains about the middle portion 524. In the embodiment of FIG. 8, at least one link 630*a*, 630*b*, 630*c* of the chains 534*a*, 534*b*, 534*c* include a projection 634*a*, 634*b*, 634*c* that has an aperture 638*a*, 638*b*, 638*c* extending therethrough. The aperture 638*a*, 638*b*, 638*c* of each of the projections 634*a*, 634*b*, 634*c* extends parallel to the respective chain 534*a*, 534*b*, 534*c* and therefore, parallel to the longitudinal axis A of the winder 522. The links 630*a*, 630*b*, 630*c* of the chains 534*a*, 534*b*, 534*c* are aligned such that the projections 634*a*, 634*b*, 634*c* are aligned parallel to the drive shaft 558. Holes 640*a*, 640*b*, 640*c* in the belt 100 are aligned with the apertures 638*a*, 638*b*, 638*c* in the projections 634*a*, 634*b*, 634*c*. An L-shaped bolt or any other suitable fastener 642*a*, 642*b*, 642*c* extends through each aperture/hole pair to couple to the belt 100 to the winder 522. In particular, a leg of each of the bolts 642*a*, 642*b*, 642*c* receives the respective holes 640*a*, 640*b*, 640*c* in the belt 100. A nut or other suitable fastening member 646*a*, 646*b*, 646*c* is secured to the leg of the bolt 642*a*, 642*b*, 642*c* to secure the belt between the chains 534*a*, 534*b*, 534*c* in of the winder 522. In the illustrated embodiment, each of the chains 534*a*, 534*b*, 534*c* includes at least one link with a projection; however, in other embodiments any combination of the chains may include at least one link including a projection, or the bolt may be integrally formed with the link or the chain. For example, only the two outer chains 638*a*, 638*c* may include projections for coupling to the free end of the belt 100. Once coupled to the winder, rotation of the drive shaft may wind and/or unwind the belt 100 about the middle portion 524 as described above with respect to FIGS. 3-7C.

Alternatively, the belt 100 may be secured to the chains 534*a*, 534*b*, 534*c* by being aligned with apertures 650*a*, 650*b*, 650*c* and receiving fasteners perpendicularly therethrough. As such, the belt 100 may also be secured to the winder 522 in a similar manner to that described above with respect to FIGS. 3-7C.

In additional or alternative embodiments, the chains 638*a*, 638*b*, 638*c* may be coupled to the conveyor belt 100 by a mechanical splice similar to the one described above with respect to FIG. 6A.

In additional or alternative embodiments, the winder 22, 322, 522 may include a fixed length conveyor belt (not shown) that forms a continuous loop about the middle portion 24, 324, 524. The fixed length conveyor belt may be coupled to the drive shaft 58, 328, 528 by sprockets 54, 354, 554 such that the fixed length conveyor belt rotates about the middle portion as the drive shaft is actuated by the prime mover. The belt 100 is coupled to the fixed length conveyor belt by bolts extending through aligned holes in the belts.

Any of the belt delivery and removal systems 12, 312, 512 shown and described herein reduce the man-hours required to move (i.e., install or remove) the belt 100. In some circumstances, the required amount of man-hours is reduced from approximately ten man-hours per move to approximately 3 man-hours per move, which translates to approximately seven man-hours saved per move. Additionally, approximately three people are required to assist with the move with the use of the system 12, 312, 512 rather than approximately five people that were previously required.

Thus, the invention provides, among other things, a system for transporting, installing and removing a belt for use with mining equipment at a mining site. Although the invention has been described in detail with reference to certain preferred embodiments, variations and modifications exist within the scope and spirit of one or more independent aspects of the invention.

What is claimed is:

1. A delivery and removal system used to transport, install, and remove a belt for use with mining equipment, the system comprising:

a first frame member;

a second frame member;

a deck extending between the first frame member and the second frame member;

a winder supported by the deck and rotatable relative to the first frame member and the second frame member about the deck, wherein a free end of the belt is coupled to the winder; and a drive system for driving movement of the winder;

wherein when the drive system is driven in a first direction, the winder rotates in a first direction such that the belt winds about the deck;

wherein when the drive system is driven in a second direction, the winder rotates in a second direction such that the belt unwinds from the deck;

wherein the drive system includes a prime mover that actuates a drive shaft coupled between the first frame member and the second frame member, the drive shaft coupled to the winder;

wherein the winder includes a connecting member forming a continuous loop about the deck, the connecting member coupled to the free end of the belt by a fastener.

2. The system of claim 1, wherein actuation of the drive shaft by the prime mover causes rotation of the winder.

3. The system of claim 1, wherein a drive sprocket is coupled to the drive shaft, the drive sprocket including teeth that drivingly engage the connecting member such that actuation of the drive shaft by the prime mover causes rotation of the connecting member.

4. The system of claim 1, wherein the winder further includes a plurality of flight bars arranged in a continuous loop about the deck and substantially parallel to the drive shaft, the connecting member being attached to the flight bars.

5. The system of claim 1, wherein the winder is rotatable about an axis that is perpendicular to a longitudinal axis of the system.

6. The system of claim 1, further comprising an elevated roller extending upwardly from and coupled between the first frame member and the second frame member, the elevated roller applying pressure to the belt.

7. The system of claim 1, wherein the belt winds about the deck to form an ovular spool.

8. A delivery and removal system used to transport, install, and remove a belt for use with mining equipment, the system comprising:

a first frame member;

a second frame member;

a deck extending between the first frame member and the second frame member;

a connecting member forming a continuous loop about the deck, a free end of the belt coupled to the connecting member; and a drive system configured to drive movement of the connecting member about the deck, wherein when the drive system is driven in a first direction, the connecting member moves in a first direction about the deck such that the belt winds about the deck;

wherein when the drive system is driven in a second direction, the at least one of the connecting member moves in a second direction about the deck such that the belt unwinds from the deck.

9. The system of claim 8, wherein the drive system includes a prime mover that actuates a drive shaft coupled between the first frame member and the second frame member.

10. The system of claim 9, wherein a drive sprocket is coupled to the drive shaft, the drive sprocket including teeth that drivingly engage the connecting member.

11. The system of claim 8, wherein the connecting member is coupled to a plurality of flight bars extending between the first frame member and the second frame member, the plurality of flight bars arranged in a continuous loop about the deck and being substantially parallel to the drive shaft.

12. The system of claim 8, wherein the belt winds about the deck to form an ovular spool.

13. The system of claim 8, further comprising a second connecting member forming a continuous loop about the deck and a second drive sprocket coupled to the drive shaft, the second sprocket including teeth that drivingly engage the second connecting member.

14. The system of claim 8, wherein the continuous loop of the connecting member is rotatable about an axis that is perpendicular to a longitudinal axis of the system.

15. The system of claim 8, further comprising an elevated roller extending upwardly from and coupled between the first frame member and the second frame member, the elevated roller applying pressure to the belt.

* * * * *